US008167584B2

(12) United States Patent
Pyke et al.

(10) Patent No.: US 8,167,584 B2
(45) Date of Patent: May 1, 2012

(54) MODULAR COMPRESSOR UNIT

(75) Inventors: Jacintha Louise Pyke, Buckinghamshire (GB); Anthony Edward Filler, Berkshire (GB)

(73) Assignee: Gardner Denver Deutschland GmbH, Bad Neustadt (DE)

( * ) Notice: Subject to any disclaimer, the term of this patent is extended or adjusted under 35 U.S.C. 154(b) by 467 days.

(21) Appl. No.: 12/438,607

(22) PCT Filed: Jul. 19, 2007

(86) PCT No.: PCT/GB2007/002751
§ 371 (c)(1),
(2), (4) Date: Feb. 24, 2009

(87) PCT Pub. No.: WO2008/025938
PCT Pub. Date: Mar. 6, 2008

(65) Prior Publication Data

US 2009/0324430 A1 Dec. 31, 2009

(30) Foreign Application Priority Data

Aug. 30, 2006 (GB) ..... 0617112.8

(51) Int. Cl.
*F04B 17/03* (2006.01)
*F04B 35/04* (2006.01)

(52) U.S. Cl. ..... 417/366; 417/423.14; 417/423.7

(58) Field of Classification Search ..... 417/366, 417/423.7, 423.14
See application file for complete search history.

(56) References Cited

U.S. PATENT DOCUMENTS

| | | | | |
|---|---|---|---|---|
| 3,586,399 | A * | 6/1971 | Muller | 384/219 |
| 3,736,074 | A | 5/1973 | Kilbane et al. | 417/279 |
| 3,748,065 | A | 7/1973 | Pilarczyk | 417/423 |
| 3,912,000 | A | 10/1975 | Nyeste | 165/47 |
| 4,311,439 | A | 1/1982 | Stofen | 417/313 |
| 4,969,803 | A | 11/1990 | Turanskyj | 417/247 |
| 5,613,843 | A | 3/1997 | Tsuru et al. | 417/313 |

(Continued)

FOREIGN PATENT DOCUMENTS

EP 1 617 081 A2 1/2006

(Continued)

OTHER PUBLICATIONS

The International Search Report dated Nov. 19, 2007, PCT/GB2007/002751.

(Continued)

*Primary Examiner* — Joseph L Williams
(74) *Attorney, Agent, or Firm* — James B. Conte; Husch Blackwell LLP

(57) ABSTRACT

The invention relates to improvements in compressor units, and in particular to a modular compressor unit which has separate sections for the compressor, the controls and the air intake. The modular compressor unit comprises three separate adjoining sections, being an intake section, a compression section and a control section. The intake section comprises air intake means which provide an inlet for ambient air to be compressed and for cooling the compressor motor and comprise filters to filter air entering the intake means, noise attenuation means provided in the air intake means, and means for directing air to components in the compression section. The compression section comprises a compressor, a motor arranged to drive all compressor and all components within the unit required to cool compressed air, the motor and to remove heat from the compression section. The control section houses all the control means for operating the compressor unit.

20 Claims, 6 Drawing Sheets

U.S. PATENT DOCUMENTS

| | | | | |
|---|---|---|---|---|
| 2003/0021701 | A1 | 1/2003 | Kolodziej et al. | 417/243 |

FOREIGN PATENT DOCUMENTS

| | | | |
|---|---|---|---|
| EP | 1 657 439 | A1 | 5/2006 |
| GB | 2 416 806 | A | 2/2006 |
| JP | 2005-207370 | | 8/2005 |

OTHER PUBLICATIONS

The Written Opinion dated Nov. 19, 2007, PCT/GB2007/002751.
Search Report from issued on the United Kingdom priority application Serial No. 0617112.8, dated Dec. 1, 2006.

* cited by examiner

MODULAR COMPRESSOR UNIT

CROSS-REFERENCE TO RELATED APPLICATION

This Application is a Section 371 National Stage Application of International Application No. PCT/GB2007/002751, filed Jul. 19, 2007, published as WO 2008/025938, in English, the content of which is hereby incorporated by reference in its entirety.

The invention relates to improvements in compressor units, and in particular to a modular compressor unit which has separate sections for the compressor, the controls and the air intake.

Oil free compressors typically comprise a single or a multi-stage compressor, a motor and gear box to drive the compressor and controls for operating the compressor. Oil free compressors may also comprise means for directing a cooling flow of air. Hitherto the design of compressor units has been dictated by the components of the units and their operation, and little consideration has been given to the overall unit design. As a result of which, the units are typically not optimised for low noise and are usually unwieldy to handle, transport and service.

It is therefore an object of the present invention to improve the overall design of a compressor unit to overcome these disadvantages.

The invention therefore provides a modular compressor unit comprising three separate adjoining sections, being an intake section, a compression section and a control section; wherein the intake section comprises air intake means which provide an inlet for ambient air to be compressed and for cooling the compressor motor and comprises filters to filter air entering the intake means, noise attenuation means provided in their intake means, and means for directing air to components in the compression section; the compression section comprises a compressor, a motor arranged to drive the compressor and all components within the unit required to cool compressed air, the motor and to remove heat from the compression section; and wherein the control section houses all the control means for operating the compressor unit.

This modular design of the compressor unit is unique for oil free compressor units. No other compressor has a layout that is similar and many compressors are unpackaged.

The modular design provides the following advantages:—

Scaling—the modular design allows for scaling of model sizes up and down the range with ease. The assembly procedure will be the same for all models, but the components will just be a different size.

Installation—the modular design enables all of the services (water, mains etc) to be located on the same side of the unit 10, something that is very important in the installation of the compressor to reduce installation space.

Assembly—the separate sections of the unit can be assembled separately, making the assembly process quicker and easier by building up sub-assemblies and reducing the down time of waiting for components.

Cooling—the cooling of the unit provides two advantages. The modular design of the controls section and the compression section enables a single cooling flow to be used. If the unit was not modular, then the cooling of the controls section would have to be done separately, meaning more exhaust outlets and extra intakes in the housing, plus additional fans.

Noise—with the housing in place, the noise level of the compressor is significantly reduced for a comparable compressor. The modular design of the present invention is key to this because all of the various noise sources are located in one section, which enables specific measure to be adopted to minimise the noise transmission to the outside. Each individual section has its own noise characteristics that can be dealt with separately. Sandwiching the compression section between the intake and controls sections enables all the high noise items to be enclosed without any direct openings to the outside of the unit, which are required for other reasons in the other sections.

The invention will now be described, by way of example only, with reference to and as shown in the accompanying drawings, in which:—

Figure 1:
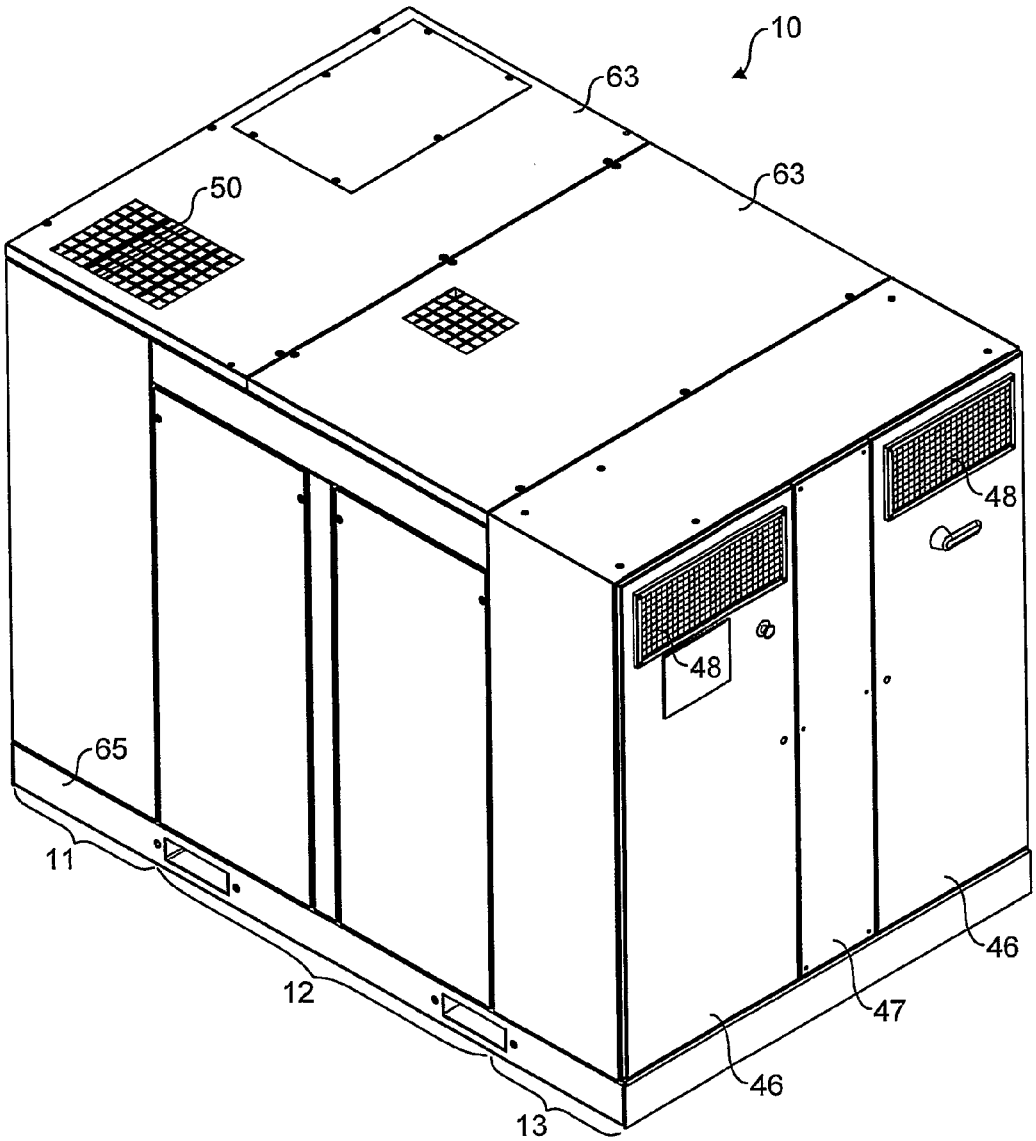
FIG. 1 is a perspective view of a compressor unit according to the present invention.

Referring first to FIG. 1, the compressor unit 10 according to the present invention comprises three distinct sections; the intake section 11, the compression section 12 and the control section 13. The use of three distinct sections 11,12,13 permits the creation of a modular design which lends itself to ease of manufacture, installation, transportation and service. It also makes the design easier to scale up or down as required with the different input power (kW) ratings of the compressor range. The three sections 11, 12, 13 of the unit 10 are wholly encased within a housing comprising a number of removable side, end and roof cover panels/doors attached to a supporting frame.

Compression Section 12

Figure 2:
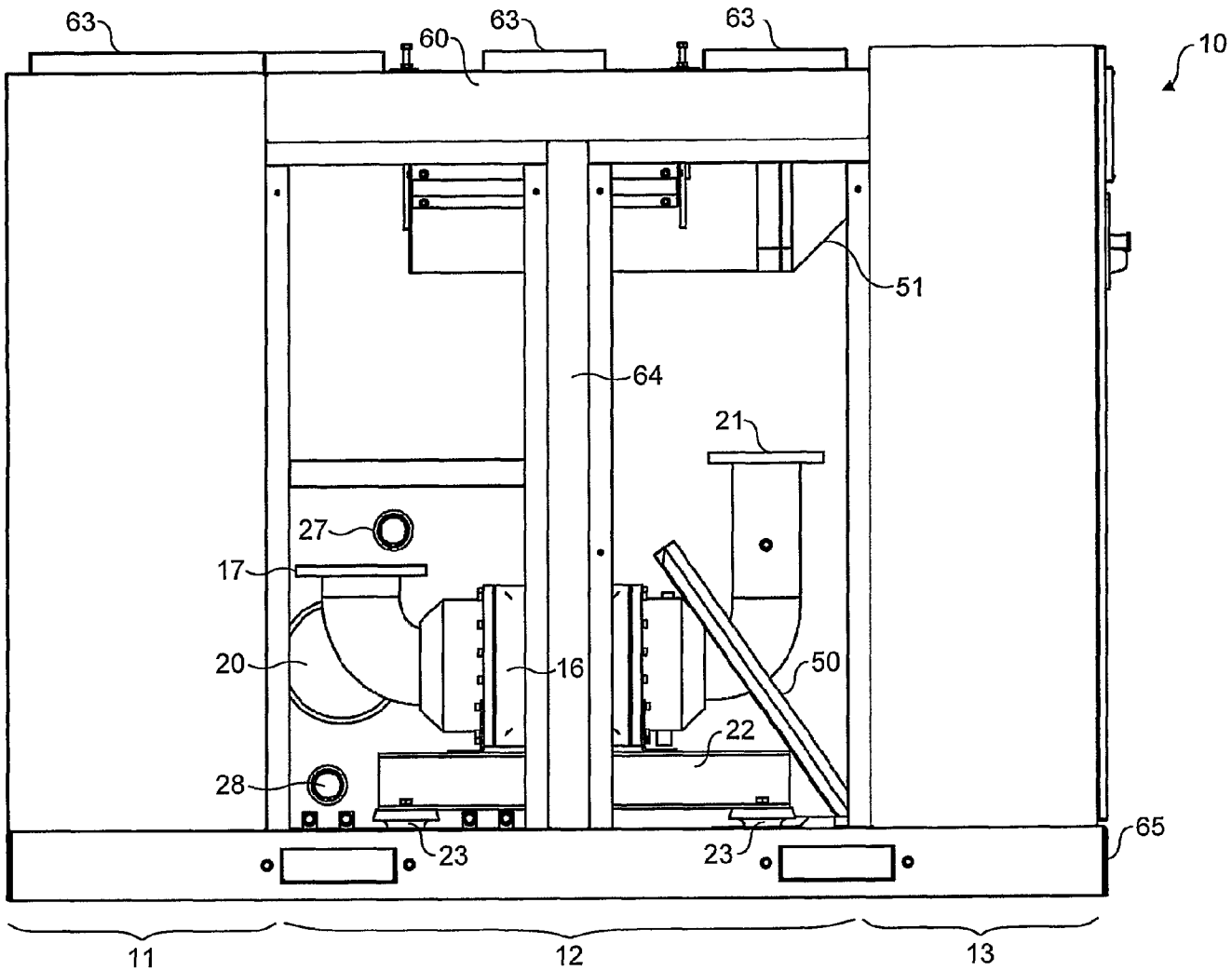
FIGS. 2 and 3 are opposing side elevations of the compressor unit of FIG. 1 with the side cover panels of the compression section removed and some components removed for clarity.
Figure 3:
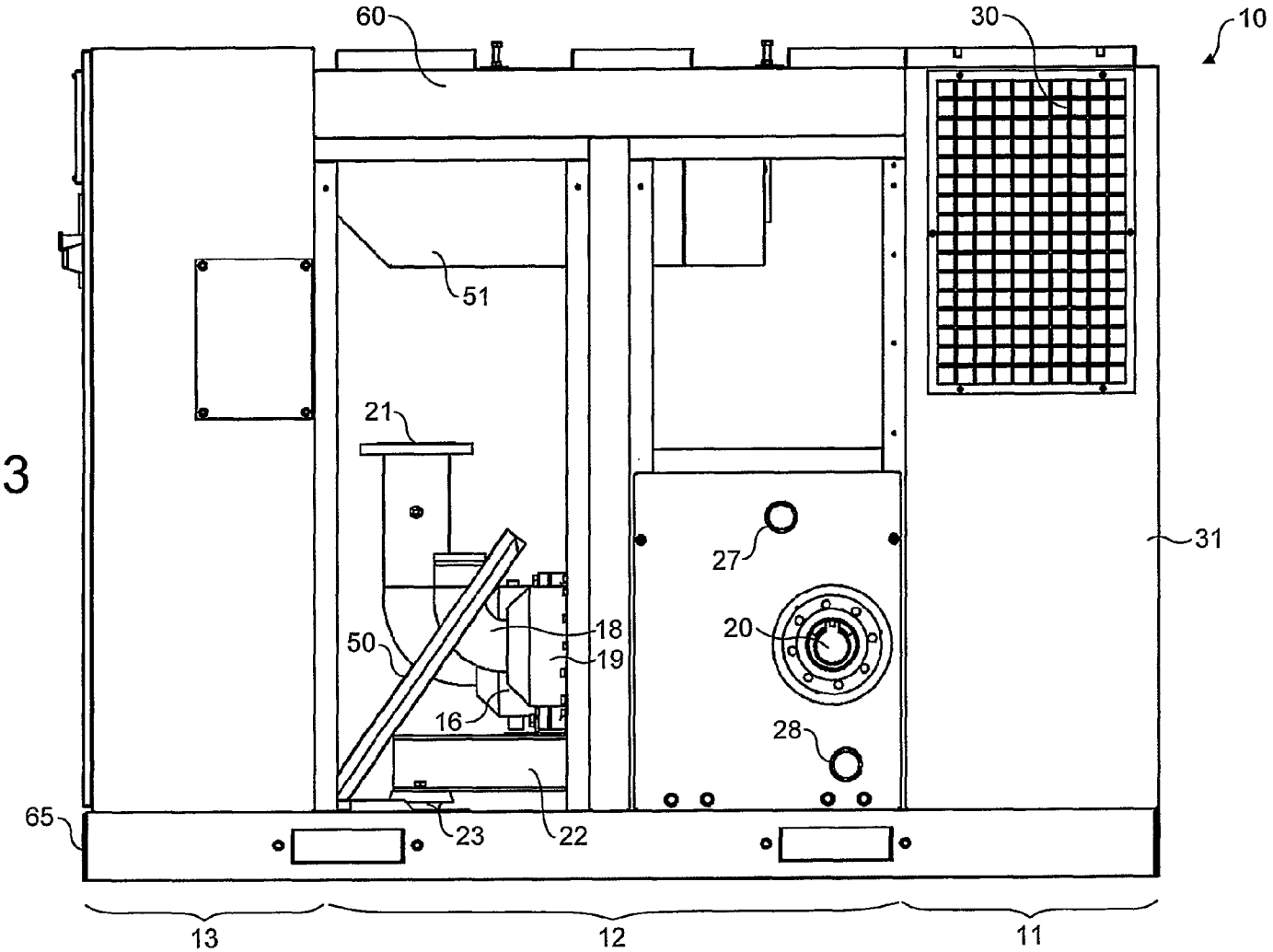
Figure 4:
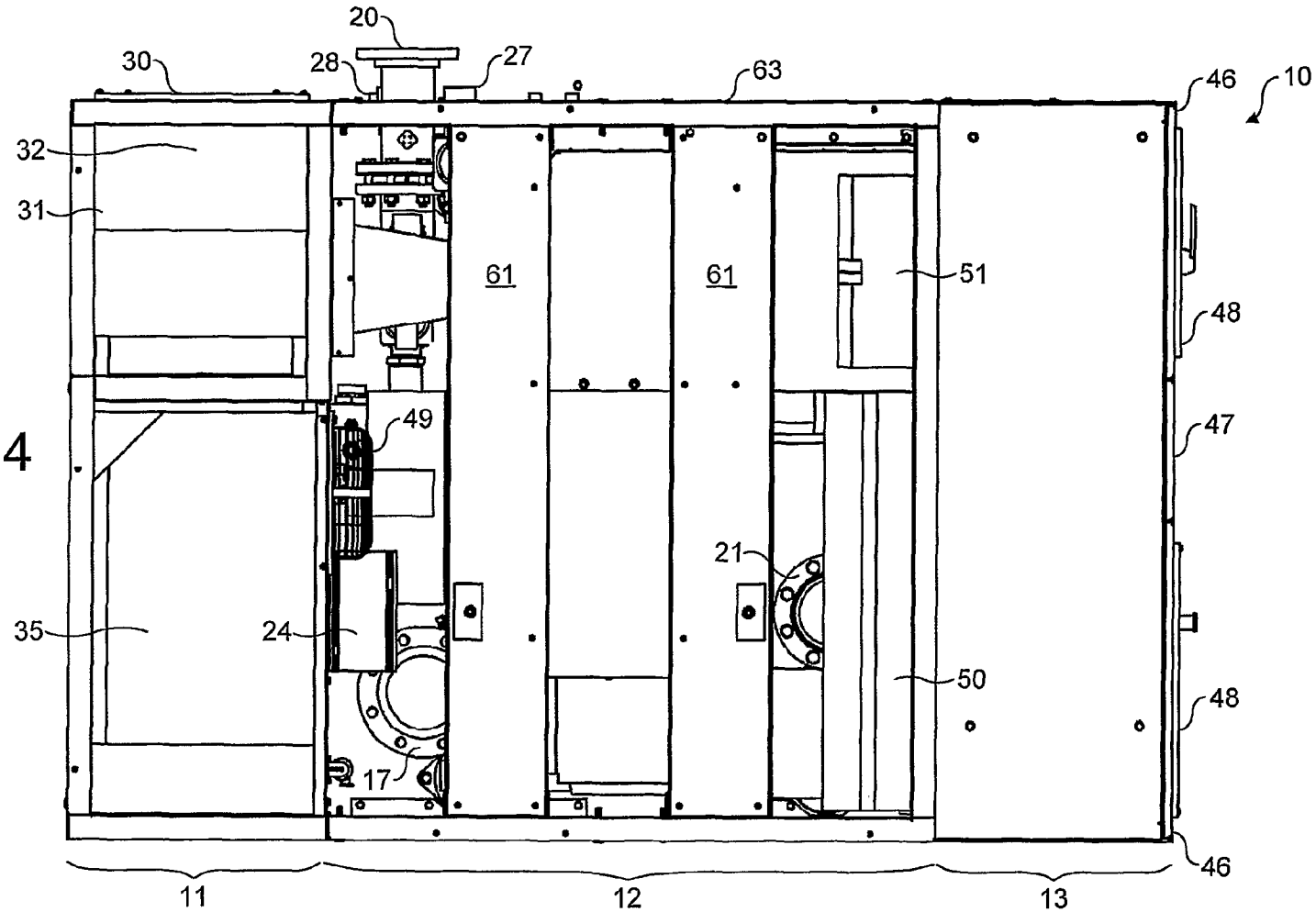
FIG. 4 is a plan view of the compressor unit of FIG. 1 with the top cover panels of the intake and compression sections removed.

Referring to FIGS. 2, 3 and 4 which illustrate the inside of the compression section 12, the compressor (not illustrated) is the main component of the compression section 12 and comprises a variable high speed motor and two stage compressor combined as a single unit with oil free bearings.

In addition to the compressor, the compression section 12 of the unit 10 contains the motor, all ancillary items required to cool the compressed air and remove the heat from the section 12 itself. The ancillary items are a cooling blower (not shown), a ventilation fan 49, coolers 16, 19, a water circuit and a blowdown circuit.

The air compressed by the $1^{st}$ stage of the compressor exits the compressor through its discharge (not shown) and flows through the $1^{st}$ stage cooler inlet manifold 17 and into the cooler where it is cooled before entering the $2^{nd}$ stage of the compressor. This cooler will be referred to hereafter as the intercooler 16. The air exits the intercooler 16 through the $2^{nd}$ stage cooler manifold 21 and enters the $2^{nd}$ stage. The compressed air, which is at final delivery pressure, exits the $2^{nd}$ stage and is directed to an inlet 18 of the aftercooler 19. The air is cooled by the aftercooler 19 before exiting the unit 10 via the air discharge 20 through a non-return valve (NRV) and into the customer's supply. The NRV prevents air from the customer's system from re-entering the circuit when the compressor is stopped or is "offload".

The intercooler 16 and aftercooler 19 are of a different design to the traditional shell and tube coolers usually used with these type of compressors. They are more compact and therefore enable the mounting arrangement of the present invention to be used.

When the compressor stops, or goes "offload", the residual air that has been compressed by the compressor has to be discharged to atmosphere to release the pressure in the compressor unit 10. To enable this, a solenoid valve (not shown) is provided on the delivery pipe that is situated before the NRV. This valve opens on a signal generated by the controls and allows the air to flow through an exhaust silencer into the intake section 11. The valve remains open until a signal is generated for it to shut again, i.e. when the compressor goes back "onload".

The motor is usually cooled by water and/or air and the cooling air is provided by a suitable motor cooling blower and is exhausted, along with any leakage air from the compression process, through two exhaust tubes. These tubes are in line with a motor air exhaust box 51. This is a box which is specifically designed to remove any noise generated by the compressor and direct the cooling flow, with minimal losses, to the outside of the compressor unit 10. It contains various specially designed baffles and sound attenuation material to do this. Preferably the motor air exhaust box 51 is a foam lined sheet metal box which has a specific shape to remove line of sight to the exhaust ports and to knock out as much sound energy as possible before the exhaust air exits the housing roof panels 63. The baffles have been designed in conjunction with the box so as to not only knock out noise, but also to assist the airflow so that the pressure drops stay within specified limits.

The motor cooling blower is preferably mounted directly to the aftercooler 19 and directly on to the motor cooling air inlet manifold.

The cooling water enters the compressor unit 10 through a water intake 27 and initially has to pass through a solenoid valve (not shown) that is only opened on a signal from the compressor when it starts. The water then flows to a water inlet manifold that distributes the flow to all areas which require cooling water, namely the motor, the intercooler 16, the aftercooler 19 and the variable speed drive. The water flow to these components is controlled by an orifice in the water outlet manifold 28 that then channels the water back out of the compressor.

The compressor is mounted on the intercooler 16 via the cooler manifolds 17, 21. All of the components of the compression section 12, except for the ventilation fan, are mounted on a sub-base 22 that sits on anti-vibration mounts 23. The 1$^{st}$ stage inlet pipe 24 and the 2$^{nd}$ stage discharge pipe are preferably flexible connections, which allow for some movement and to allow for manufacturing tolerances of assemblies.

The arrangement of the compressor mounting is unique because it is mounted between the 1st stage discharge and 2nd stage intake flanges on the intercooler manifolds 17,21 with the motor suspended in the middle. The flanges allow for thermal expansion, thereby avoiding the need for more bulky and expensive expansion joints.

The mounting of the compressor and the design of the manifolds 17,18 also means that the compressor is suspended, which provides easy servicing access to the compressor and the coolers 16,19. The unit 10 of the present invention has been specifically designed to provide this advantage.

The frame of the compressor unit housing comprises side rails 60, centre rails 61 and columns 64, and provides the structure which supports the weight of the compressor. The horizontal side rails 60 are located at the top of the housing and are attached to the intake section 11 and the controls section 13 at either end. The centre rails 61 are attached to each side rail 60 and support the roof panels 63.

The centre rails 61, which support the roof cover panels 63, are also used to jack up the compressor from its mounted position at either end via suitable attachment means. The compressor is mounted directly on to specially designed manifolds, which connect it to the intercooler 16. Instead of the traditional shell or tube cooler, the intercooler 16 has a special design, which facilitates this mounting arrangement. The use of some types of oil free bearings makes it possible for this mounting arrangement to be viable as the system is effectively vibrationless.

Mounting the compressor in this way has the following advantages:

- Ease of assembly—the assembly only has two connections for mounting. The entire compression section 12 can therefore be made as a sub-assembly and then put into the unit 10.
- Compact design—the combined design of the 2nd stage cooler manifold and the 2nd stage inlet negate the need for a long length of straight pipe going into the second stage axially.
- Cost—only a simple gasket or O-ring is required to seal the flange connections, so this is cheaper than a complex coupling. There is no mounting foot for the compressor so no extra framework is required for mounting the motor. As the compressor is part of the compression section 12, the whole assembly is isolated, removing the cost for separate isolators for the compressor.
- Servicing—as the compressor is only mounted via the first stage discharge and second stage inlet flanges to the intercooler manifolds 17, 21, this enables the discharge pipes of the compressor to be removed to give access to the rotors and also allows the coolers 16, 19 to be removed for cleaning. No prior art compressor is supported in this way to provide for ease of servicing. One person can jack up the compressor, and no heavy lifting equipment is needed to suspend the compressor. The components can be inspected regularly if required, and components can be changed easily. This means that the unit 10 can be located in much smaller areas than the prior art compressors.

This is a unique arrangement for compressors. In prior art arrangements having an air end/motor unit mounted on top of a cooler, this requires flexible connections on the 1st stage discharge and the 2nd stage intake and the motor is mounted via feet on top of the coolers.

Each of the above features contribute to the compact nature of the inventive arrangement.

Intake Section 11

Figure 5:
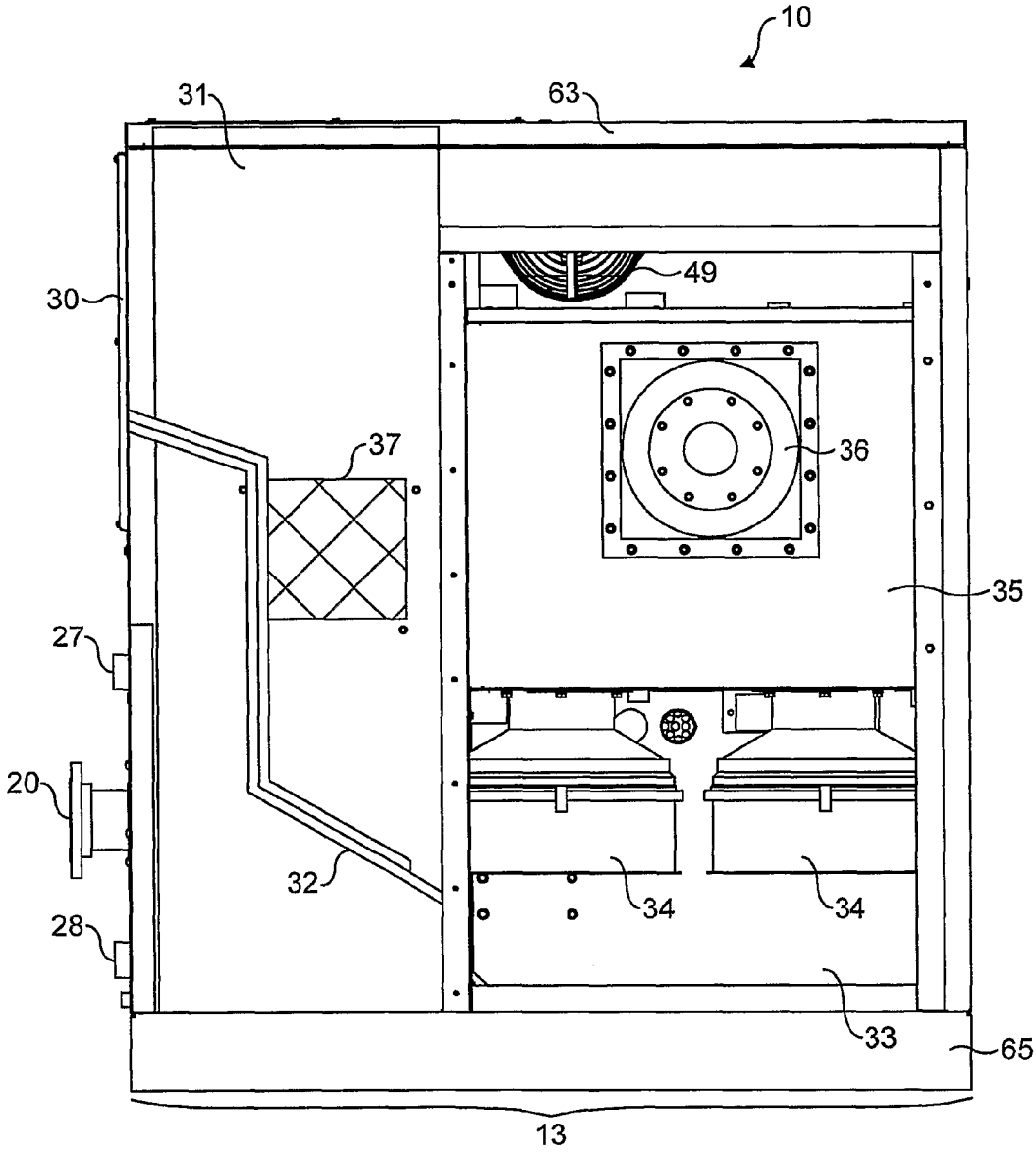
FIG. 5 is an end elevation of the compressor unit of FIG. 1 with the end cover panels of the intake section removed.

The intake section 11 provides the means for the compressor to draw air into the unit 10. The air initially passes through a coarse filter mesh 30 on the outside of an intake duct 31, as shown in FIGS. 3 and 5. The intake duct 31 has a noise attenuation baffle 32 which is specifically designed to remove the compressor intake noise without reducing the airflow or increasing the pressure drop. The air is drawn through the intake duct 31 and into the intake chamber 33 where the air is then drawn through two air intake filters 34. The air intake filters 34 are attached to the underside of a plenum chamber 35 with plenty of surrounding space to aid servicing operations. The 1$^{st}$ stage intake to the compressor is attached to an intake bellmouth 36 via a rubber connector and the bellmouth 36 is attached inside the plenum chamber 35. The air flows into the 1$^{st}$ stage through the bellmouth 36, which provides uniform airflow into the 1st stage of the compressor.

Cooling air for the compressor motor is also drawn through the coarse filter mesh 30 before passing through a gap in the intake duct 31, through a secondary filter 37 and into the cooling air blower housed in the compression section 12.

Controls Section 13

Figure 6:
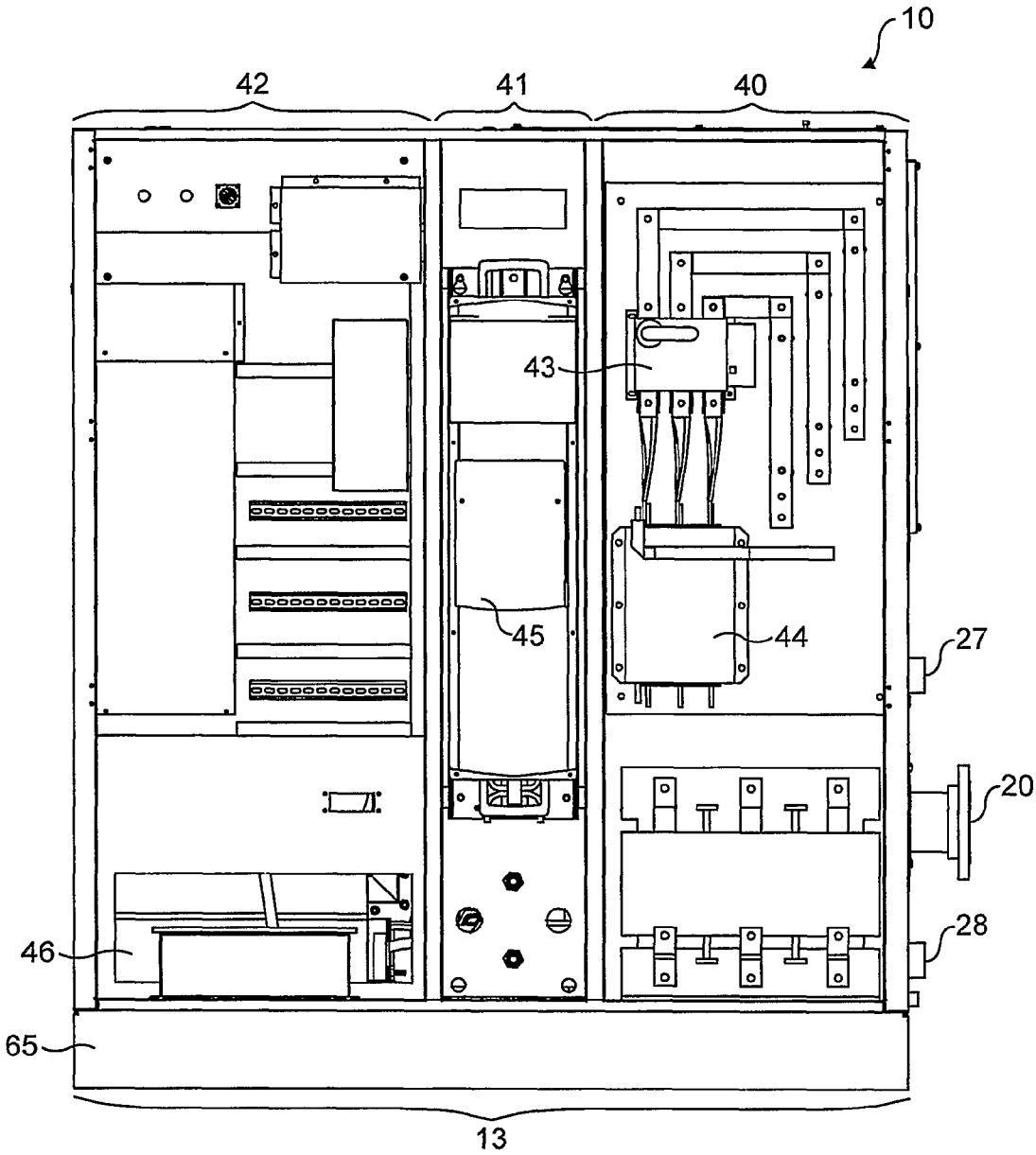
FIG. 6 is an opposite end elevation of the compressor unit of FIG. 1 with the end cover panel and doors of the control section removed.

The controls section 13 contains all of the electrical components required to control the compressor 14. As can be seen in FIG. 6 this section 13 is sub-divided into three sub-sections, an incoming power supply section 40, a variable speed drive section 41 and an auxiliary component section 42.

As a safety requirement, incoming mains electricity passes through an isolating switch 43 in the first sub-section 40 before it is distributed to the rest of the electrical circuits. It then passes through an EMC (Electromagnetic Compatability) filter 44 to a line reactor and into the variable speed drive 45, which is housed in the second sub-section 41. The supply for the auxiliary components is taken off in between the EMC filter 44 and the line reactor to power the control transformer, bearing controller, contactors and user interface in the third sub-section 42.

The auxiliary components section 42 and the incoming power supply section 40 have openable doors 46 (see FIG. 1) but the variable speed drive section 41 is accessed though a lift off end panel 47. This is to help control EMC emissions.

The controls section 13 is cooled by air that is drawn through two external filters 48 that are situated in the top of the two hinged access doors 46 of section 13. The air is directed through the section 13 by finger protection guards, which have been designed to also aid with noise reduction. The control section 13 has various openings that allow the air to flow between the incoming power supply section 40, variable speed drive section 41, and auxiliary component section 42 to cool the components as necessary. These openings are different sizes to direct the correct amount of air to the various parts of the control section 13 and then through openings 46 into the compression section 12.

A ventilation fan 49 which is situated at the opposite end of the unit 10 (see FIG. 4) draws the air into the unit 10 through the external filters 48, through the controls section 13, into the compression section 12 before exiting the unit 20 via duct 50 (see FIG. 1), which is situated above the intake plenum chamber 35. This air is directed by the exhaust box 51 which acts as a cooling/noise attenuation baffle to draw air over the hot surfaces in the compression section 12 and therefore keep the temperature within the unit 10 at an acceptable level.

Baffles are also provided in the controls section 12, which have four functions;

1) to attenuate any noise that may come through the external filters 48;
2) to assist the unit 10 cooling by directing the air flow over the correct components in the section 13;
3) to help with EMC screening; and
4) to protect the user from electrical shock and comply with electrical safety codes.

Remote Monitoring

The unit 10 may be provided with a remote monitoring facility. This enables the service schedules to be dynamic so that components are only replaced when they need to be, thus helping with environmental issues and product lifecycle costs. It also enables remote fault diagnosis that reduces down time of the compressor.

Set service schedules for consumable elements of the compressor can be eliminated, as all temperatures and pressures can be monitored remotely. Using this facility, it is possible to determine when components need changing or cleaning. A controller constantly monitors certain parameters and files of data can be extracted remotely. This data can be analysed to determine when to change filters or clean coolers.

The advantages of remote monitoring are as follows:

For the compressor—if the unit 10 is operating in a dirty environment the filters may need to be changed on a more regular basis. This prevent the efficiency of the machine from dropping below specified levels and prolongs the compression life.

For the customer—if the unit 10 is used in a clean environment, the consumable items are only changed as and when required, thereby reducing service costs and downtime of the compressor for cleaning.

For the environment—items are only changed as and when they need to be and chemicals for cleaning the coolers 16, 19 are only used when necessary.

Transportation

The design of the sub-base 22 and the design of the mounting arrangement means that the only component that needs to be supported during transportation is the compressor. The anti-vibration mounts 23 used for the sub-base 22 do not need any attachments to isolate movement during transportation, which makes transportation significantly easier.

The invention claimed is:

1. A modular compressor unit comprising three separate adjoining sections, being an intake section, a compression section and a control section; wherein the intake section comprises air intake means which provide an inlet for ambient air to be compressed and for cooling the compressor motor and comprises filters to filter air entering the intake means, noise attenuation means provided in their intake means, and means for directing air to components in the compression section; the compression section comprises a compressor, a motor arranged to drive the compressor, at least one intercooler, at least one aftercooler for cooling the compressed air and all components within the unit required to cool compressed air, the motor and to remove heat from the compression section; and wherein the control section houses all the control means for operating the compressor unit; and wherein the compressor and motor are mounted on the intercooler by means of flanges on inlet and outlet manifolds of the intercooler, said compressor between the flanges with the motor suspended in the middle.

2. A modular compressor unit as claimed in claim 1 in which the compression section is located between the intake section and the control section.

3. A modular compressor unit as claimed in claim 1 in which the compressor motor is a variable speed motor.

4. A modular compressor unit as claimed in claim 3 in which the variable speed motor has a motor rotor supported by oil free bearings.

5. A modular compressor unit as claimed in claim 1 in which the intercooler is mounted on a sub-base which is mounted on a base of the unit on anti-vibration mounts.

6. A modular compressor unit as claimed in claim 1 in which the compressor is a multi-stage compressor having at least a first stage and a second stage, in which an inlet to the first stage and a discharge from the second stage have flexible means for connecting the compressor to other components of the unit.

7. A modular compressor unit as claimed in claim 1 in which the control section further comprises noise attenuation means.

8. A modular compressor unit as claimed in claim 1 in which the unit is encased within a housing comprising a frame and a plurality of removable cover panels.

9. A modular compressor unit as claimed in claim 8 in which the frame comprises horizontal side rails attached either end to the intake section and control section centre rails attached to the side rails so as to support the roof cover panel and intermediate columns on either longitudinal side of the unit which are attached at either end to a lower side of the side rails and a base of the housing.

10. A modular compressor unit as claimed in claim 9 in which the centre rails are provided with means for supporting the compressor from the frame to enable it to be removed from its mounting.

11. A modular compressor unit as claimed in claim 1 further comprising ventilation means for cooling the unit comprising air inlets into the control section, communicating means between the control section and compression section to enable the air to flow into the compression section, a fan located at an opposite end of the compression section to the communicating means for drawing air through the air inlet and the control section and into the compression section, and means for directing an air flow through the control section and the compression section to cool apparatus located therein.

12. A modular compressor unit as claimed in claim 11 in which the ventilation means further comprises duct means in the air intake section for directing the air flow out of the unit.

13. A modular compressor unit as claimed in claim 11 in which the means for directing the air flow through the control and compression section comprise noise attenuation means.

14. A modular compressor unit as claimed in claim 11 in which the means for directing the air flow through the control section further comprise a means of screening electromagnetic compatibility.

15. A modular compressor unit as claimed in claim 11 in which the means for directing the air flow through the control section further comprise a means for protecting an operator of the unit from electrical shock.

16. A modular compressor unit as claimed in claim 1 in which means are provided for attaching a mounting beam to rigidly support the compressor on the frame during transportation of the unit.

17. A modular compressor unit as claimed in claim 1 in which the compression section further comprises a motor air exhaust box to attenuate the noise from the exhaust air.

18. A modular compressor unit as claimed in claim 17 in which the motor air exhaust box is lined with a noise attenuation material.

19. A modular compressor unit as claimed in claim 17 in which the motor air exhaust box has no line of sight to the unit exhaust ports.

20. A modular compressor unit as claimed in claim 1 further comprising means for remotely monitoring the unit, said monitoring means comprising a controller located in the control section monitoring predetermined parameters of the compressor and other apparatus within the unit and a means for transmitting data to a remote location.

* * * * *